US007936242B2

(12) United States Patent
Carpenter

(10) Patent No.: US 7,936,242 B2
(45) Date of Patent: May 3, 2011

(54) MAGNETICALLY OPERATED ELECTRICAL SWITCH

(76) Inventor: William N Carpenter, Auburn, CA (US)

( * ) Notice: Subject to any disclaimer, the term of this patent is extended or adjusted under 35 U.S.C. 154(b) by 356 days.

(21) Appl. No.: 11/901,159

(22) Filed: Sep. 14, 2007

(65) Prior Publication Data

US 2010/0231334 A1 Sep. 16, 2010

(51) Int. Cl.
*H01H 9/00* (2006.01)

(52) U.S. Cl. ..... 335/205; 335/207

(58) Field of Classification Search ..... 335/6, 127, 335/202, 293–294, 205, 207
See application file for complete search history.

(56) References Cited

U.S. PATENT DOCUMENTS

| | | | | | |
|---|---|---|---|---|---|
| 2,521,723 | A * | 9/1950 | Hubbell | 335/207 |
| 3,465,271 | A * | 9/1969 | Koepke | 335/205 |
| 3,567,880 | A * | 3/1971 | Palmer et al. | 200/61.08 |
| 3,637,986 | A | 1/1972 | Laing | |
| 3,689,716 | A * | 9/1972 | Csurgay | 200/61.18 |
| 3,801,767 | A * | 4/1974 | Marks | 200/543 |
| 4,117,431 | A * | 9/1978 | Eicher | 335/207 |
| 4,271,763 | A * | 6/1981 | Berger | 104/179 |
| 4,317,969 | A * | 3/1982 | Riegler et al. | 200/52 R |
| 4,719,334 | A | 1/1988 | Rebel | |
| 4,792,651 | A * | 12/1988 | Whiting | 200/82 E |
| 4,837,539 | A * | 6/1989 | Baker | 335/207 |
| 5,920,131 | A * | 7/1999 | Platt et al. | 307/104 |
| 6,016,020 | A | 1/2000 | Cline | |
| 6,545,576 | B1 * | 4/2003 | Marchini et al. | 335/205 |
| 6,623,276 | B2 * | 9/2003 | Dalmau Ferrerfabrega et al. | 439/39 |
| 6,636,135 | B1 * | 10/2003 | Vetter | 335/205 |
| 6,812,435 | B2 * | 11/2004 | Schilling | 219/457.1 |
| 7,066,415 | B2 | 6/2006 | Strutz | |
| 2005/0219022 | A1 | 10/2005 | Batteux | |
| 2006/0011759 | A1 | 1/2006 | Chavez | |
| 2006/0144975 | A1 | 7/2006 | Anderson | |

* cited by examiner

*Primary Examiner* — Elvin G Enad
*Assistant Examiner* — Alexander Talpalatskiy
(74) *Attorney, Agent, or Firm* — Ariel S. Bentolila; Bay Area IP Group, LLC

(57) ABSTRACT

A magnetically operated electrical switch is presented. The electrical switch includes a linear magnet assembly contained within a housing and movable along an axis of the housing, a rod attached to an end of the linear magnet facing an open end, and means for attaching the housing to a surface. An electrical switch assembly attachable to the open end includes a make/break switch, a switch plunger and an operating lever engaging the plunger where the make/break switch is placed in the first position when an end of the operating lever is contacted by the rod. An electrical wire connection harness includes at least two conductors where the make/break switch closes/opens a connection between one of the conductors. When an operating magnet assembly is positioned on the surface proximate to the switch, the operating magnet moves the linear magnet and a position of the make/break switch is changed.

15 Claims, 5 Drawing Sheets

MAGNETICALLY OPERATED ELECTRICAL SWITCH

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to the control of electrical appliances and machines. More particularly, the invention relates to means for operating an electrical appliance or machine via the attractive force of a repositionable magnet as the operator or "key" and a fixed magnet or electrical switch assembly that opens and closes an electrical circuit.

BACKGROUND OF THE INVENTION

Typically, the operation of an appliance or machine requires the use of an air-operated switch or a mechanical switch such as, but not limited to, a wall switch or a switch on the machine or appliance. These switches allow for unauthorized use of the machines or appliances that they control because these types of switches are generally unguarded. Furthermore, wall switches and countertop mounted switches are typically time consuming and potentially expensive to install because the installation of these switches may require actions such as, but not limited to, cutting holes in sinks countertops and walls, connecting wires, and installing tubes. Air switches have the added disadvantage of several additional required mechanical parts causing them to be inherently less reliable than other switches.

In view of the foregoing, there is a need for improved means of operation for electrical appliances and machines that prevents unauthorized users from using the appliance or machine and is inexpensive and easy to install.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
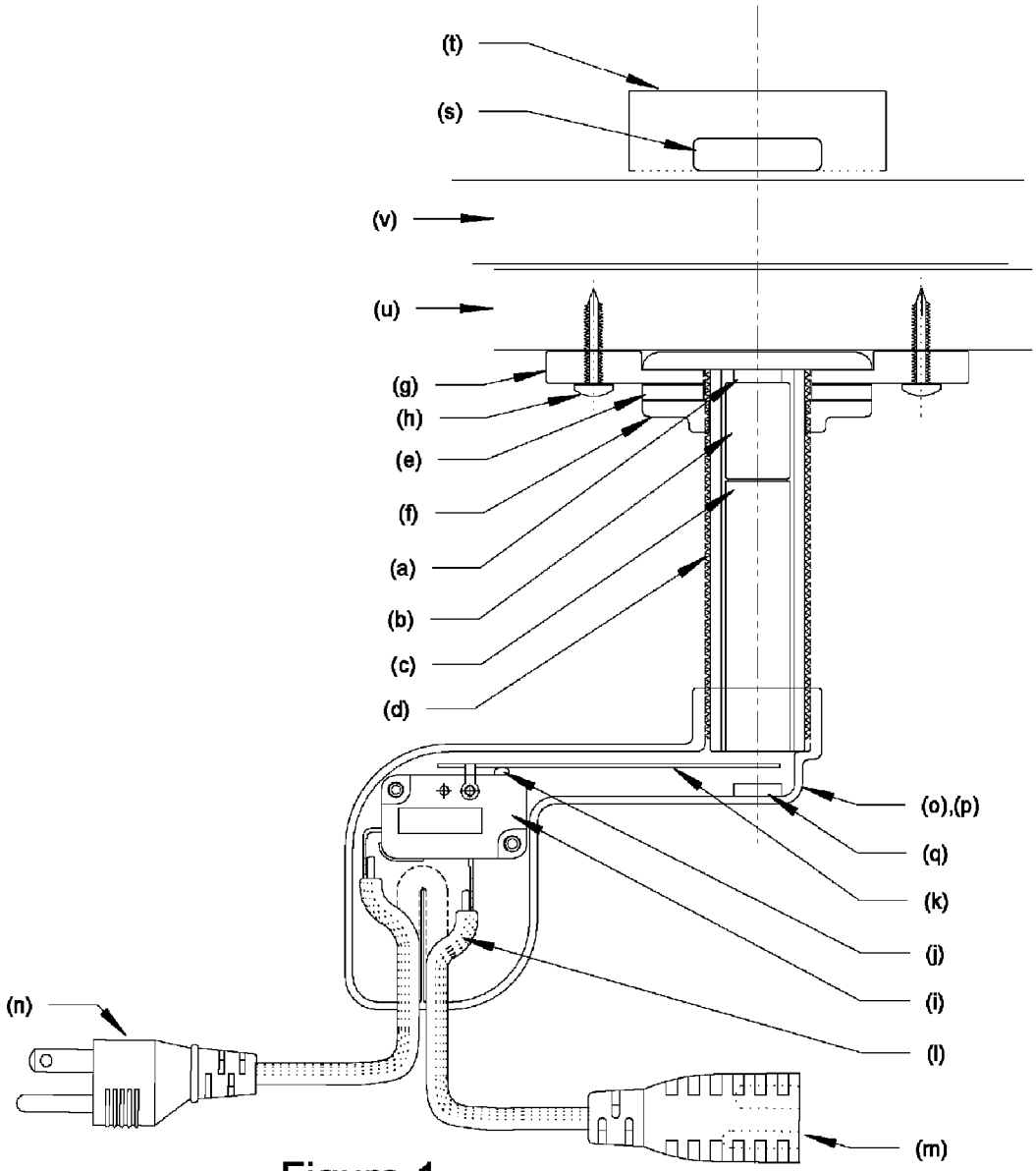
FIG. 1 illustrates a cross sectional view of an exemplary magnetically operated electric switch mounted on the underside of a countertop, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, a magnetically operated electrical switch is presented.

In one embodiment, a magnetically operated electrical switch is presented. The electrical switch includes a linear magnet assembly including a housing having a generally cylindrical shape having a closed end and an open end, a linear magnet contained within the housing and movable along an axis of the housing, a linear magnet dampener attached to an end of the linear magnet (b), a rod attached to the opposite end of the linear magnet facing the open end, and means for attaching the housing to a surface in a manner such that the housing is substantially perpendicular to the surface and the closed end is adjacent to the surface. An electrical switch assembly attachable to the open end includes a switch assembly housing, a make/break switch contained within the assembly housing having first and second positions, a switch plunger contained within the assembly housing for operating the make/break switch, and a switch plunger operating lever contained within the assembly housing for engaging the switch plunger where an end of the switch plunger operating lever contacts the rod when a force extends the rod beyond the open end placing the make/break switch in the first position. An electrical wire connection harness attached to the make/break switch includes a multi conductor electrical wire having a standard electrical female connector and a standard electrical male connector where the make/break switch closes/opens a connection between the female and male connectors. An operating magnet assembly includes an operating magnet and an operating magnet housing wherein when the operating magnet assembly is positioned on the surface proximate to the closed end, the operating magnet attracts the linear magnet, and the rod retracts into the housing disengaging contact with the operating lever placing the make/break switch in the second position.

In another embodiment, a magnetically operated electrical switch is presented. The electrical switch includes linear magnet assembly means for housing a movable linear magnet, means for mounting the linear magnet assembly means to a surface, switch assembly means attachable to the linear magnet assembly means for operating the electrical switch in response to a movement of the linear magnet, harness means for connecting electrical connectors to the electrical switch and operating magnet assembly means for moving the linear magnet wherein a position of the electrical switch is changed.

In another embodiment, a magnetically operated electrical switch is presented. The electrical switch includes a linear magnet assembly including a housing having a closed end and an open end, a linear magnet contained within the housing and movable along an axis of the housing, a rod attached to an end of the linear magnet facing the open end, and means for attaching the housing to a surface in a manner such that the closed end is adjacent to the surface. An electrical switch assembly attachable to the open end includes a switch assembly housing, a make/break switch contained within the assembly housing having first and second positions, a switch plunger contained within the assembly housing for operating the switch, and a switch plunger operating lever contained within the assembly housing and engaging the plunger where the make/break switch is placed in the first position when an end of the switch plunger operating lever is contacted by the rod. An electrical wire connection harness attached to the make/break switch includes a multi conductor electrical wire having a least two connectors where the make/break switch closes/opens a connection between the connectors. An operating magnet assembly having an operating magnet and an operating magnet housing wherein when the magnet assembly is positioned on the surface proximate to the closed end, the operating magnet moves the linear magnet and a position of the make/break switch is changed.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of present invention, recognized a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternatives embodiments do not necessarily imply that the two are mutually exclusive.

The present invention will now be described in detail with reference to embodiments thereof as illustrated in the accompanying drawings.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

The preferred embodiment of the present invention uses the attracting force of two magnets to operate a high current electrical switch. The preferred embodiment solves the problem of unauthorized use of appliances via an unguarded wall or air-operated countertop switch. The preferred embodiment also reduces the time and expense required to install a wall switch or air-operated countertop switch, specifically the cutting of holes into sinks, counter tops and walls, the connecting of wires, and the installation of tubes, etc. Unlike a wall switch or an air-operated switch, the preferred embodiment enables electrically isolated operation of the controlled appliance, the prevention of the operation of the appliance by unauthorized users; and the operation of the appliance control switch through the depth of a countertop surface and countertop support materials without holes drilled into the surface.

For example, without limitation, using the preferred embodiment of the present invention, a user can operate a kitchen sink food waste disposer, hot water dispenser, or other appliance by positioning a magnetic operator "key" at a specific location on a kitchen countertop, directly above a switch assembly, causing the switch circuit to close and the appliance to start. The novel mechanical design of the preferred embodiment enables it to be used equally well in counter tops without holes, or may replace existing air-switches where a hole in the counter top currently exists. A simple method of installation for the preferred embodiment requires only a screwdriver and standard plug-in electrical connection.

Embodiments of the present invention may be used by entities such as, but not limited to, manufacturers of food waste disposers and in machines or appliances such as, but not limited to hot water dispensers, filtered water dispensers, lighting equipment, consumer electronic equipment, and/or other consumer/industrial equipment that require the features listed above. Embodiments of the present invention may also be used by consumers or service providers who use equipment such as, but not limited to, food waste disposers, hot water dispensers, filtered water dispensers, lighting equipment, consumer electronic equipment, etc.

FIG. 1 illustrates a cross sectional view of an exemplary magnetically operated electric switch mounted on the underside of a countertop, in accordance with an embodiment of the present invention. The present embodiment comprises five sections, a linear magnet assembly, an electrical switch assembly, an electrical wire connection harness, an enclosure feature, and an operating magnet assembly. The linear magnet assembly comprises a linear magnet dampener (a), a linear magnet (b), a linear magnet attachment rod (c), a linear magnet and rod housing (d), a linear magnet and rod housing gasket (e), a linear magnet and rod housing fastening nut (f), a linear-magnet and rod housing fastening plate (g), and linear magnet and rod housing fastening plate screws (h). The electrical switch assembly comprises a circuit make/break switch (i), a circuit switch plunger (j), and a circuit switch plunger operating lever (k). The electrical wire connection harness comprises a multi conductor electrical wire (l) with a standard electrical female connector (m) and a standard electrical male connector (n). The enclosure assembly comprises a primary section (o), a mating secondary section (p), a circuit switch operating lever dampener (q), and an enclosure branding ID label (r). The operating magnet assembly comprises an operating magnet (s) and an operating magnet housing (t).

In the present embodiment, make/break switch (i) is a high-current momentary type switch with normally closed contacts. Make/break switch (i) is mounted upright in a suitable housing, primary section (o) and mating secondary section (p) of the enclosure assembly, in a position such that circuit switch plunger (j) of the switch can be operated via vertical linear motion. The mass of linear magnet dampener (a), linear magnet (b), and linear magnet attachment rod (c), combined, have sufficient force to actuate circuit switch plunger (j) via circuit switch plunger operating lever (k). When operating magnet (s) is in proximity to linear magnet (b) with attracting magnetic poles of both magnets aligned, sufficient magnetic attractive force is present to cause the linear magnet assembly to overcome gravitational force and creates a condition to enable circuit switch plunger (j) to rise to a normal resting state. When circuit switch plunger (j) is in the normal resting state, the circuit switch contacts are closed and electrical current may flow to the appliance or machine from an electrical supply source via the electrical wire connection harness, specifically multi conductor electrical wire (l). In the present embodiment, the arrangement of the electrical wires enables alternate connectors to be attached at any time by way of adapters or by removal of the standard molded ends and the attachment of the preferred type of electrical connector, if any.

When operating magnet (s) is removed from the proximity of linear magnet (b), the linear magnet assembly lowers into an off state, causing switch plunger operating lever (k) to move actuating make/break switch (i) downward. The actuation of make/break switch (i) opens the circuit switch contacts, breaking the circuit and cutting the flow of the electrical current to the appliance or machine. In the present embodiment as linear magnet (b) moves up and down, linear magnet and rod housing (d) guides linear magnet (b) so that linear magnet (b) remains in the linear magnet assembly. Linear magnet dampener (a) and circuit switch operating lever dampener (q) dampen the impact of linear magnet (b) and linear magnet attachment rod (c) when reaching the top or the bottom of their movement. These dampeners may be made of any suitable material that is sufficiently soft to dampen the impact of linear magnet (b) and linear magnet attachment rod (c), for example, without limitation, rubber or plastic.

The complete assembly may be mounted inconspicuously under the countertop using linear magnet and rod housing fastening plate (g) and linear magnet and rod housing fastening plate screws (h). Rod housing fastening plate screws (h) are placed in holes in rod housing fastening plate (g) and screwed into the underside of a countertop support structure (u) allowing for practical use of the present embodiment without drilling a hole in a surface material (v) of the countertop. Linear magnet and rod housing (d) is held in place against the underside of countertop support structure (u) with rod housing fastening plate (g) when rod housing fastening plate (g) is securely fastened to the underside of countertop support structure (u). Alternatively, as shown by way of example in FIG. 2, linear magnet and rod housing (d) may be used to fasten the complete assembly through a hole in the countertop using linear magnet and rod housing gasket (e) and linear magnet and rod housing fastening nut (f). In the present embodiment, the outer surface of linear magnet and rod housing (d) is threaded, and rod housing fastener nut (f) threads onto linear magnet and rod housing (d). Rod housing fastener nut (f) may be used to further secure the assembly to the underside of the countertop, and rod housing gasket (e) is placed between linear magnet and rod housing (d) and surface material (v). Alternate embodiments may rely only on rod housing fastener plate (g) to secure the assembly on the underside of the countertop.

Using, the preferred embodiment of the present invention, a user operates an electrical device, an appliance or machine, by placing operating magnet (s) near linear magnet (b) until linear magnet (b) is lifted. This enables circuit switch plunger (j) to rise, causing the switch contacts to close the circuit and operate the electrical device. The repositionable magnetic key, operating magnet (s), is housed in operating magnet housing (t). Operating magnet housing (t) may be incorporated into a variety of common decorative or functional household tabletop items in order to disguise the operating magnet assembly when the assembly is on the countertop or via an obvious and purposefully designed enclosure to clearly indicate the function of the operating magnet housing (t). For example, without limitation, operating magnet (s) and operating magnet housing (t) may be incorporated into the base of a paper towel dispenser or a decorative tile, or operating magnet (s) may be housed in a plastic operating magnet housing (t) that indicates the appliance that it controls, for example without limitation, "Garbage Disposal".

Figure 2:
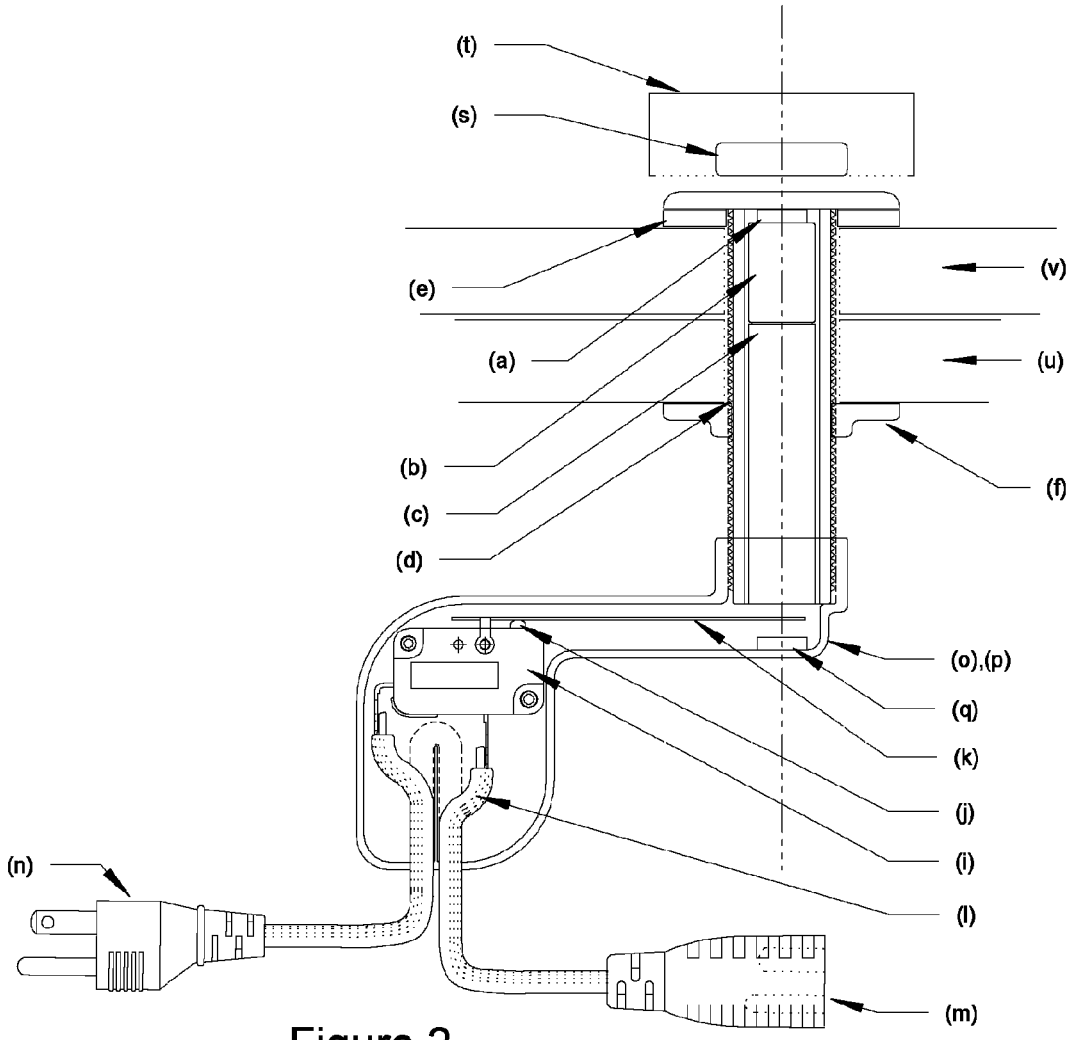
FIG. 2 illustrates a cross sectional view of an exemplary magnetically operated electric switch mounted in a hole in a countertop, in accordance with an embodiment of the present invention.

FIG. 2 illustrates a cross sectional view of an exemplary magnetically operated electric switch mounted in a hole in a countertop, in accordance with an embodiment of the present invention. The present embodiment comprises the same elements as shown by way of example in FIG. 1. Linear magnet and rod housing (d) is placed in a hole in countertop surface material (v) and countertop support structure (u) so that the closed end of the linear magnet and rod housing (d) is above countertop surface material (v) and the linear magnet assembly and the electrical switch assembly are below the countertop. Rod housing fastening nut (f) is tightened into place on linear magnet and rod housing (d) up against the underside of countertop support structure (u). Linear magnet and rod housing gasket (e) is placed between linear magnet and rod housing (d) and top of countertop surface material (v). Rod housing fastening nut (f) generally prevents the assembly from moving up and down in the hole in the countertop when tightened.

The use of magnets with different geometries such as, but not limited to, rod and disk geometries can effect the interaction of the magnets because of the unique magnetic field exhibited by differing geometric shape(s) the magnets. Pairings of different sizes and shapes of magnets may be used to take advantage of the unique properties of each individual magnet of the magnet pair, to enable the Invention function. In the preferred embodiment, high-strength rare earth magnets are used to enable the device to function through multiple layers of materials. However, in alternate embodiments, different types of magnets may be used, depending on the types of materials from which the countertop is constructed. In the preferred embodiment, the mass of the operating magnet is tuned to the operating force of the switch lever, and the specific combination of a linear magnet and an operating magnet make the operation of the device possible. Therefore, in order to prevent an unauthorized user from using the appliance or machine controlled by the switch, the use of the operating magnet corresponding to the switch may be restricted to only authorized users. If a magnet of insufficient strength or size or quality is used in an attempt to operate the controlled device, the attempt will fail.

An alternate embodiment comprises a single powerful magnet used to act on and attract a piece of ferrous metal attached to the switch lever instead of two magnets with attracting fields. In another alternate embodiment, an electrical cable may be manufactured without male and female connectors at the ends of the electrical cable. In another alternate embodiment, the circuit switch plunger operating lever may be eliminated with the circuit switch plunger being operated directly by the mass of the linear magnet and linear magnet attachment rod to simplify the design. In another alternate embodiment, the circuit switch plunger operating lever and linear magnet attachment rod may be eliminated with the circuit switch plunger being operated directly by the mass of the linear magnet to simplify the design. In yet another alternate embodiment; magnetically operated systems can be used to operate high-current devices.

Figure 3:
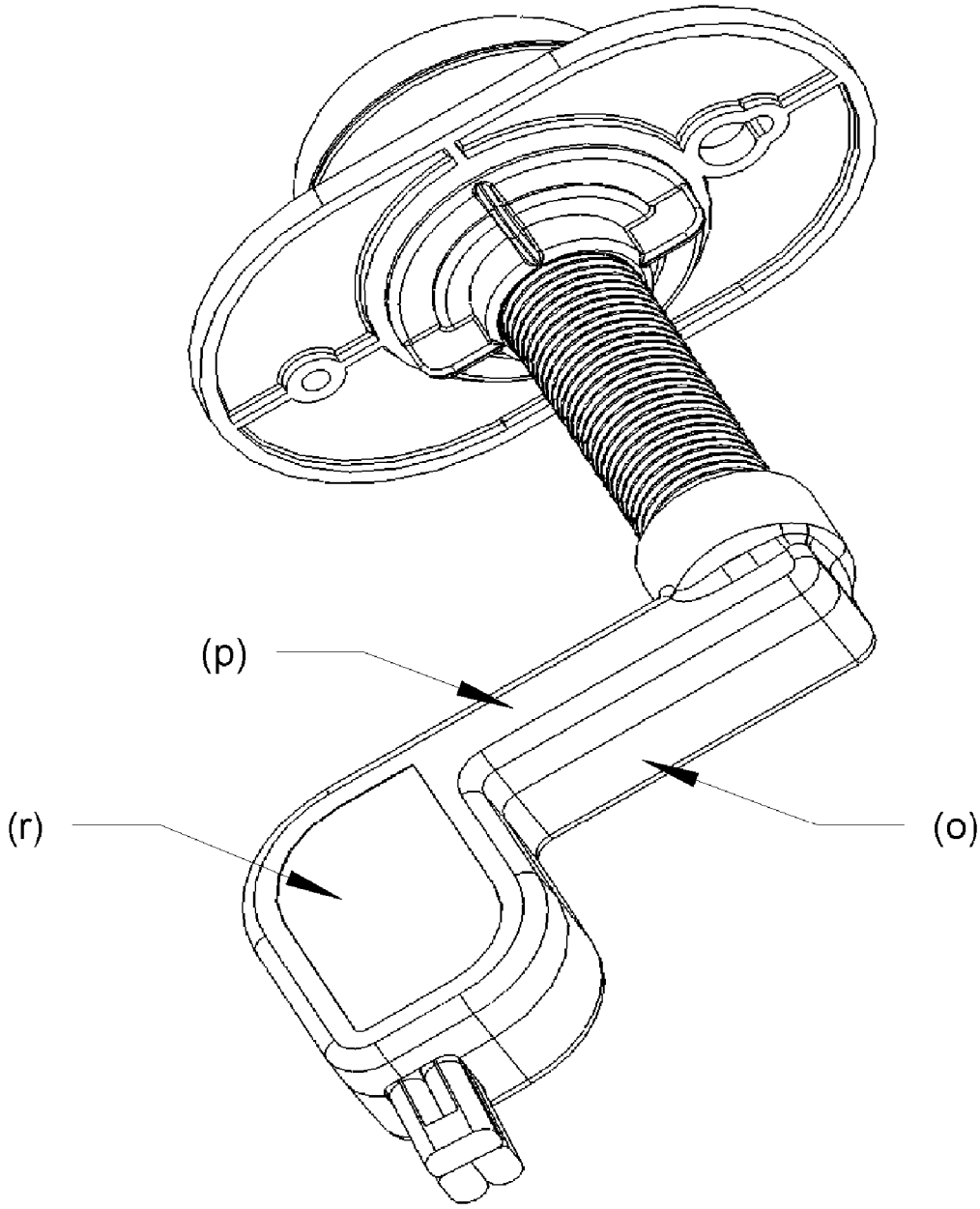
FIG. 3 illustrates a perspective external view of the magnetically operated electric switch, in accordance with an embodiment of the present invention.
Figure 4:
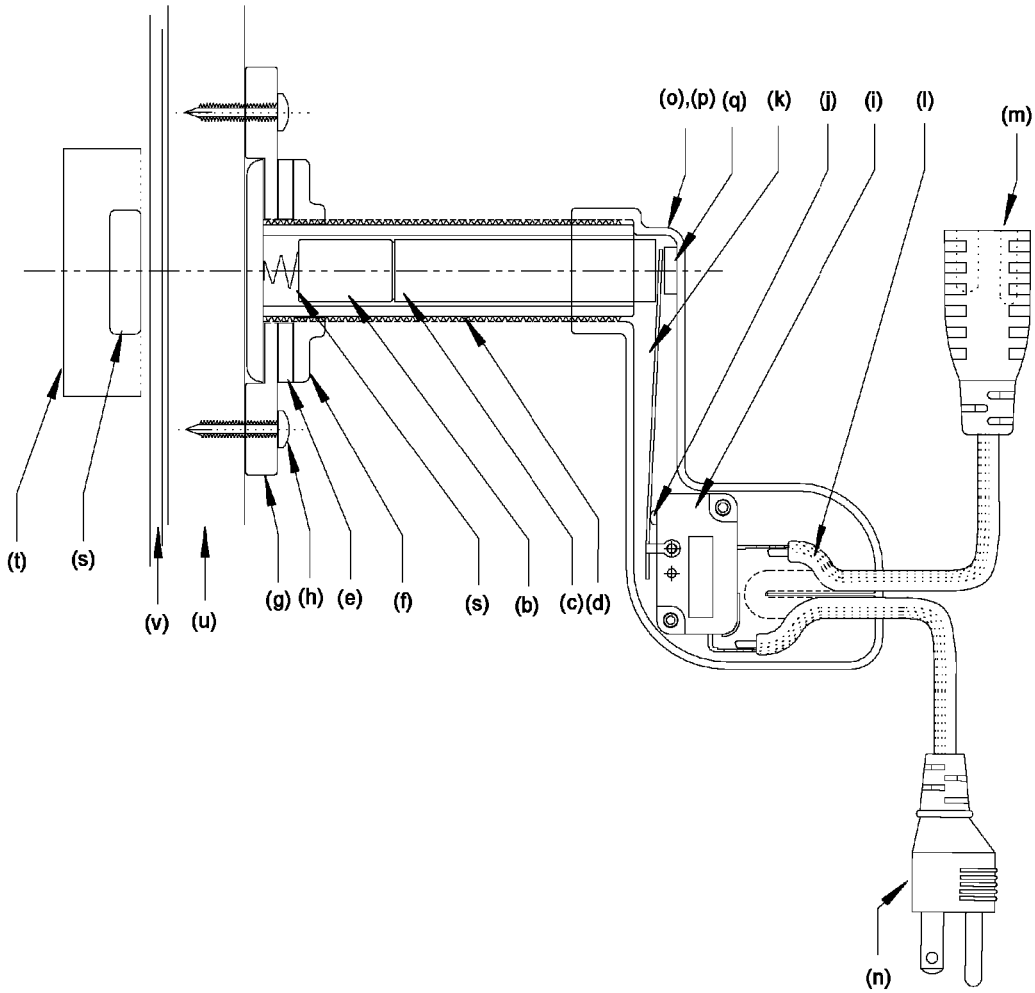
FIGS. 4 and 5 illustrates cross sectional views of exemplary embodiments of the present invention where a spring (s) is added in the linear magnet assembly such that it enables the switch to be operated in other than a vertical position.
Figure 5:
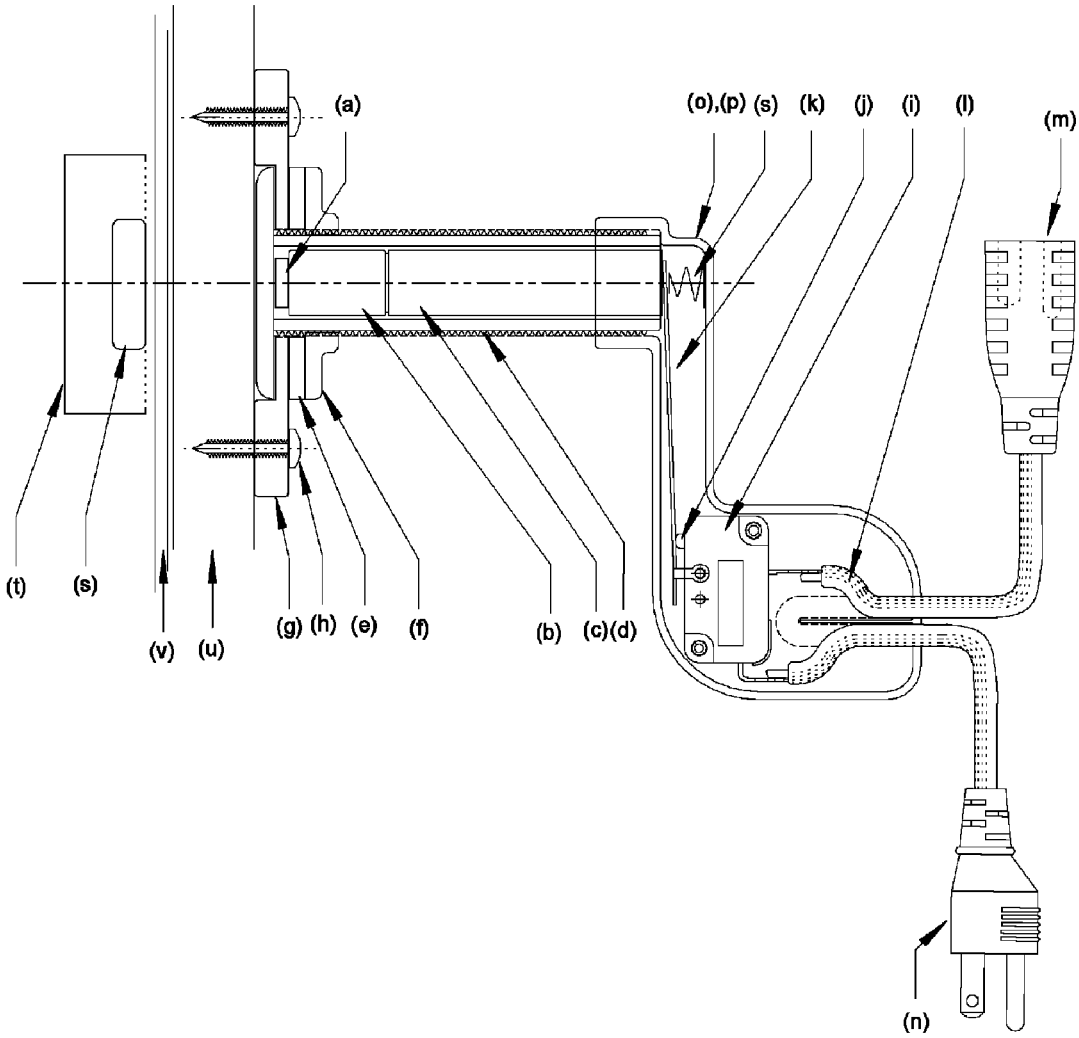

FIG. 3 illustrates a perspective external view of the magnetically operated electric switch, in accordance with an embodiment of the present invention;

FIGS. 4 and 5 illustrates cross sectional views of exemplary embodiments of the present invention where a spring (s) is added in the linear magnet assembly such that it enables the switch to be operated in other than a vertical position. In the embodiment of FIG. 4, t spring (s) provides the force to push the magnet and rod to the lever instead of gravity, allowing the switch to be positioned in a vertical surface. In the embodiment of FIG. 5, spring (s) is positioned to force the rod away from the lever, and as such repelling magnetic forces would activate the switch.

Having fully described at least one embodiment of the present invention, other equivalent or alternative means for implementing a magnetically operated electric switch according to the present invention will be apparent to those skilled in the art. For example, without limitation, the embodiments above describe a switch that has normally closed contacts. Alternate embodiments may use a switch with normally open contacts. In these embodiments, placing the operating magnet near the switch assembly breaks the flow of electricity through the circuit and turns off the appliance or machine. In yet other alternate embodiments, the repelling force of the magnets may be used to actuate the switch rather than the attracting force of the magnets by aligning the magnets with repelling poles facing each other. Also, the previous embodiments are described as functioning through a countertop. This may be a conventional kitchen or bathroom countertop or may be another type of surface such as, but not limited to, a tabletop or a shelf. The invention has been described above by way of illustration, and the specific embodiments disclosed are not intended to limit the invention to the particular forms disclosed. The invention is thus to cover all modifications, equivalents, and alternatives falling within the spirit and scope of the following claims.

What is claimed is:

1. A magnetically operated electrical switch comprising:

a linear magnet assembly comprising:

a housing comprising a hollow shape having a closed end and an open end; a linear magnet contained within said housing and movable along an axis of said housing; a rod attached to an end of said linear magnet facing said open end; a linear magnet dampener attached to said linear magnet at the opposite end; and means for attaching said housing to a surface in a manner such that said housing extends in a direction substantially perpendicular to said surface and said closed end is adjacent to said surface;

an electrical switch assembly attachable to said open end, said assembly comprising:

a switch assembly housing; a make/break switch contained within said assembly housing comprising first and second positions; a switch plunger contained within said assembly housing for operating said make/break switch; and a switch plunger operating lever contained within said assembly housing engaging said switch plunger where an end of said switch plunger operating lever contacts said rod when a force extends said rod beyond said open end placing said make/break switch in said first position;

an electrical wire connection harness attached to said make/break switch comprising a multi conductor electrical wire having a standard electrical female connector and a standard electrical male connector where said make/break switch closes/opens a connection between said female and male connectors; and an operating magnet assembly comprising an operating magnet and an operating magnet housing wherein when said operating magnet assembly is positioned on an opposite side of said surface from and proximate to said closed end, said operating magnet attracts said linear magnet, and said rod retracts into said housing disengaging contact with said operating lever placing said make/break switch in said second position.

2. The magnetically operated electrical switch as recited in claim 1, wherein the configuration and magnetic properties of said operating magnet are matched to said linear magnet allowing said operating magnet to move said linear magnet.

3. The magnetically operated electrical switch as recited in claim 2, said linear magnet and said operating magnet comprise high-strength rare earth magnets.

4. The magnetically operated electrical switch as recited in claim 1, wherein said force is gravitational.

5. The magnetically operated electrical switch as recited in claim 1, wherein said force is via a mechanical energy storage device.

6. The magnetically operated electrical switch as recited in claim 5, wherein said mechanical energy storage device is a spring.

7. The magnetically operated electrical switch as recited in claim 1, further comprising a switch plunger operating lever dampener positioned beneath said end.

8. The magnetically operated electrical switch as recited in claim 1, wherein said first position is an open switch position and said female connector is disconnected from said male connector.

9. The magnetically operated electrical switch as recited in claim 1, wherein said second position is a closed switch position and said female connector is connected to said male connector.

10. A magnetically operated electrical switch comprising:

a linear magnet assembly comprising:

a housing comprising a closed end and an open end; a linear magnet contained within said housing and movable along an axis of said housing; a rod attached to an end of said linear magnet facing said open end; and means for attaching said housing to a surface in a manner such that said closed end is adjacent to said surface;

an electrical switch assembly attached to said open end, said assembly comprising:

a switch assembly housing; a make/break switch contained within said assembly housing comprising first and second positions; a switch plunger contained within said assembly housing for operating said switch; and a switch plunger operating lever contained within said assembly housing and engaging said plunger where said make/break switch is placed in said first position when an end of said switch plunger operating lever is and a switch plunger operating lever dampener positioned beneath said open end;

an electrical wire connection harness attached to said make/break switch comprising a multi conductor electrical wire having a least two connectors where said make/break switch closes/opens a connection between said connectors; and an operating magnet assembly comprising an operating magnet and an operating magnet housing wherein when said magnet assembly is positioned on an opposite side of said surface from and proximate to said closed end, said operating magnet moves said linear magnet and a position of said make/break switch is changed.

11. The magnetically operated electrical switch as recited in claim 10, wherein the configuration and magnetic properties of said operating magnet are matched to said linear magnet allowing said operating magnet to move said linear magnet.

12. The magnetically operated electrical switch as recited in claim 11, said linear magnet and said operating magnet comprise high-strength rare earth magnets.

13. The magnetically operated electrical switch as recited in claim 10, further comprising a linear magnet dampener attached to end of magnet.

14. The magnetically operated electrical switch as recited in claim 10, wherein said first position is an open switch position and said connectors are disconnected.

15. The magnetically operated electrical switch as recited in claim 10, wherein said second position is a closed switch position and at least two connectors are connected.

* * * * *